US011617913B2

(12) United States Patent
Anderson et al.

(10) Patent No.: US 11,617,913 B2
(45) Date of Patent: Apr. 4, 2023

(54) EXERCISE APPARATUS

(71) Applicants: Jerrod Daniel Anderson, Allen, TX (US); Clinton Robert Anderson, Tulsa, OK (US)

(72) Inventors: Jerrod Daniel Anderson, Allen, TX (US); Clinton Robert Anderson, Tulsa, OK (US)

( * ) Notice: Subject to any disclaimer, the term of this patent is extended or adjusted under 35 U.S.C. 154(b) by 352 days.

(21) Appl. No.: 16/647,016

(22) PCT Filed: Sep. 12, 2018

(86) PCT No.: PCT/IB2018/056955
§ 371 (c)(1),
(2) Date: Mar. 12, 2020

(87) PCT Pub. No.: WO2019/053603
PCT Pub. Date: Mar. 21, 2019

(65) Prior Publication Data
US 2020/0276469 A1 Sep. 3, 2020

Related U.S. Application Data

(60) Provisional application No. 62/674,361, filed on May 21, 2018, provisional application No. 62/557,437, filed on Sep. 12, 2017.

(51) Int. Cl.

| | |
|---|---|
| ***A63B 21/072*** | (2006.01) |
| ***A63B 21/00*** | (2006.01) |
| ***A63B 21/075*** | (2006.01) |
| *B25G 3/20* | (2006.01) |

(52) U.S. Cl.
CPC ..... *A63B 21/072* (2013.01); *A63B 21/075* (2013.01); *A63B 21/4035* (2015.10); *A63B 21/4047* (2015.10); *A63B 21/4049* (2015.10); *B25G 3/20* (2013.01)

(58) Field of Classification Search
CPC ..... A63B 21/0004; A63B 21/072; A63B 21/0722; A63B 21/0724; A63B 21/0726; A63B 21/0728; A63B 21/075; A63B 21/08; A63B 21/15; A63B 21/159; A63B 21/4027; A63B 21/4033; A63B 21/4035; A63B 21/4047; A63B 21/4049; A63B 2225/09; A63B 2225/093; A63B 2244/09; B25G 3/20
See application file for complete search history.

(56) References Cited

U.S. PATENT DOCUMENTS

| | | | |
|---|---|---|---|
| 3,495,857 | A | 2/1970 | Hawke et al. |
| 4,566,819 | A | 1/1986 | Johnston |
| 4,624,374 | A | 11/1986 | Murtaugh |
| 4,784,385 | A | 11/1988 | D'Angelo |

(Continued)

FOREIGN PATENT DOCUMENTS

CA 2675186 A1 * 2/2011 ..... A63B 21/154

*Primary Examiner* — Gary D Urbiel Goldner

(57) ABSTRACT

An exemplary first apparatus includes a cylindrical sleeve that attaches to a rod such as a barbell. The first apparatus also includes a arcuate portion that connects to a handle to allow the handle to move to and be secured at various user selected angles. An exemplary second apparatus is a core training device that includes a pair of rotatable handles and a number of connectors that allow for additional resistance to be added a different points on the device.

10 Claims, 7 Drawing Sheets

(56) References Cited

U.S. PATENT DOCUMENTS 4,822,035 A * 4/1989 Jennings ..... A63B 21/0724 482/106
4,900,183 A 2/1990 Souchko
4,913,419 A 4/1990 McAuliffe
5,013,034 A 5/1991 March et al.
5,024,434 A * 6/1991 Smith ..... A63B 21/0728 482/106
5,133,582 A * 7/1992 Rocha ..... A01B 1/026 294/58
5,312,308 A 5/1994 Hamilton et al.
5,443,232 A 8/1995 Kesinger et al.
5,499,852 A * 3/1996 Seigendall ..... B25G 1/00 294/58
6,283,425 B1 9/2001 Liljevik
6,478,500 B1 11/2002 Farenholtz
6,581,246 B1 * 6/2003 Polette ..... A01D 34/90 16/444
6,786,302 B2 9/2004 Liew et al.
7,837,598 B1 * 11/2010 Boozel, Jr. ..... A63B 23/03525 482/38
7,883,452 B1 2/2011 Chen
8,267,841 B1 9/2012 Allison et al.
8,974,354 B1 3/2015 Nelson et al.
D808,474 S * 1/2018 Tochigi ..... B25G 1/00 D21/681
10,188,899 B1 * 1/2019 Acuna, Jr. ..... A63B 21/0442
10,940,356 B2 * 3/2021 Anderson ..... A63B 21/4047
2003/0130096 A1 * 7/2003 LaCroce ..... A63B 21/0724 482/106
2004/0063553 A1 4/2004 Viscount
2004/0081510 A1 4/2004 Zheng
2004/0245513 A1 12/2004 Izumi
2005/0227831 A1 * 10/2005 Mills ..... A63B 21/075 482/106
2011/0173778 A1 7/2011 Wales
2012/0252641 A1 10/2012 Odneal et al.
2013/0143719 A1 * 6/2013 Selek ..... A63B 23/16 482/49
2013/0210589 A1 8/2013 Thompson et al.
2014/0259533 A1 * 9/2014 Day ..... A45F 5/10 16/426
2015/0174445 A1 6/2015 Robertson, Jr.
2016/0144219 A1 5/2016 Koenig
2017/0120104 A1 * 5/2017 Douglass ..... A63B 23/14
2017/0354838 A1 * 12/2017 Fitzpatrick ..... A63B 1/00

* cited by examiner

EXERCISE APPARATUS

TECHNICAL FIELD

This application generally relates to weightlifting equipment and more specifically relates to apparatus that allow users to effectively perform resistance training. These pieces of equipment were designed to provide a better, more efficient, and more effective workout than what other pieces of equipment offer providing a full body or specific specialized isolated workout to the user depending on the way they are utilized and setup. Any major muscle group can be strengthened with the use of these devices and they may be used by general fitness users, bodybuilders, strength athletes, powerlifters, and/or any and all competitive sport athletes.

BACKGROUND

In the market today, there exists may pieces of training and weightlifting equipment. There has always been a distinct separation between the weight room and the playing field. It is advisable that athletes are trained according to the demands of their particular sport rather than for pure strength. The idea is 'functional' strength relative to the sport the athlete is competing in. The movement patterns and requirements of an offensive lineman, specifically, require a different training regime and different pieces of equipment than a baseball or basketball player. With the current examples, it is desirable to close the gap between the weight room and the playing field providing strength training equipment that mimic and provide more specific movement patterns related to the athletes' sport.

SUMMARY

An apparatus may include one or more of a receiver, wherein the receiver is substantially cylindrical on a first end and substantially circular on a second end, and a handle including a lower portion, wherein the handle is substantially oblong, wherein the lower portion and the second end are detachably attached to one another via one or more securing objects positioned in a first aperture disposed on the second end, wherein the receiver is configured to be detachably attached to a substantially cylindrical element via the one or more securing objects positioned in a second aperture disposed on the first end.

In another example embodiment, an apparatus may include a receiver, wherein the receiver is substantially cylindrical on a first end and substantially circular on a second end, and a handle including a lower portion, wherein the handle is substantially oblong, wherein the lower portion and the second end are detachably attached to one another via one or more securing objects positioned in a first aperture disposed on a bottom portion of the second end, wherein the receiver is configured to be detachably attached to a substantially cylindrical element via the one or more securing objects positioned in a second aperture disposed on an upper portion of the first end.

In another embodiment, an apparatus may include one or more of a central portion, an end portion located on each end of the central portion, and a substantially circular handle disposed within each of the substantially semicircular portions, wherein the handles are at opposing angles to one another, wherein the central portion includes at least one eyelet configured to receive one or more elements.

BRIEF DESCRIPTION OF THE DRAWINGS

The novel features believed to be characteristic of this apparatus are set forth with particularity in the appended claims. The apparatus itself, however, both as to its organization and method of operation, together with further objects and advantages thereof, may best be understood by reference to the following description taken in connection with the accompanying drawings in which:

DETAILED DESCRIPTION

In the current weightlifting environment, numerous weight rooms contain multiple "Jammer" machines that take up massive amounts of space and can be extremely expensive to obtain. These machines have two handles that the athlete grabs onto and in a standing athletic position will thrust the handles forward with arms straight out. This machine is on a fixed track and not dynamic in movement. In one embodiment, the current device is designed to fit onto the end of a barbell that provides a more robust workout for the user due to the dynamic and unrestrained nature of the barbell in its pivot (landmine, sledmine, or against the wall/corner). This device setup is more cost effective and allows the weight room to accommodate and train more athletes than the typical jammer setup. For example, football offensive line trainers may utilize the device to simulate a football athlete striking an opponent with their hands inside a defender's shoulders and the puts the users elbows more in line with the body in a better biomechanical position for power transfer. Different training equipment, such as the previously mentioned "Jammer" machine and other similar devices do not position the athlete in a manner that is conducive to football athletes. The attachment pieces can be removed from the receiver allowing any style of handle to be utilized so any competitive athlete or user can replicate the motion they desire for their sport.

Figure 1:
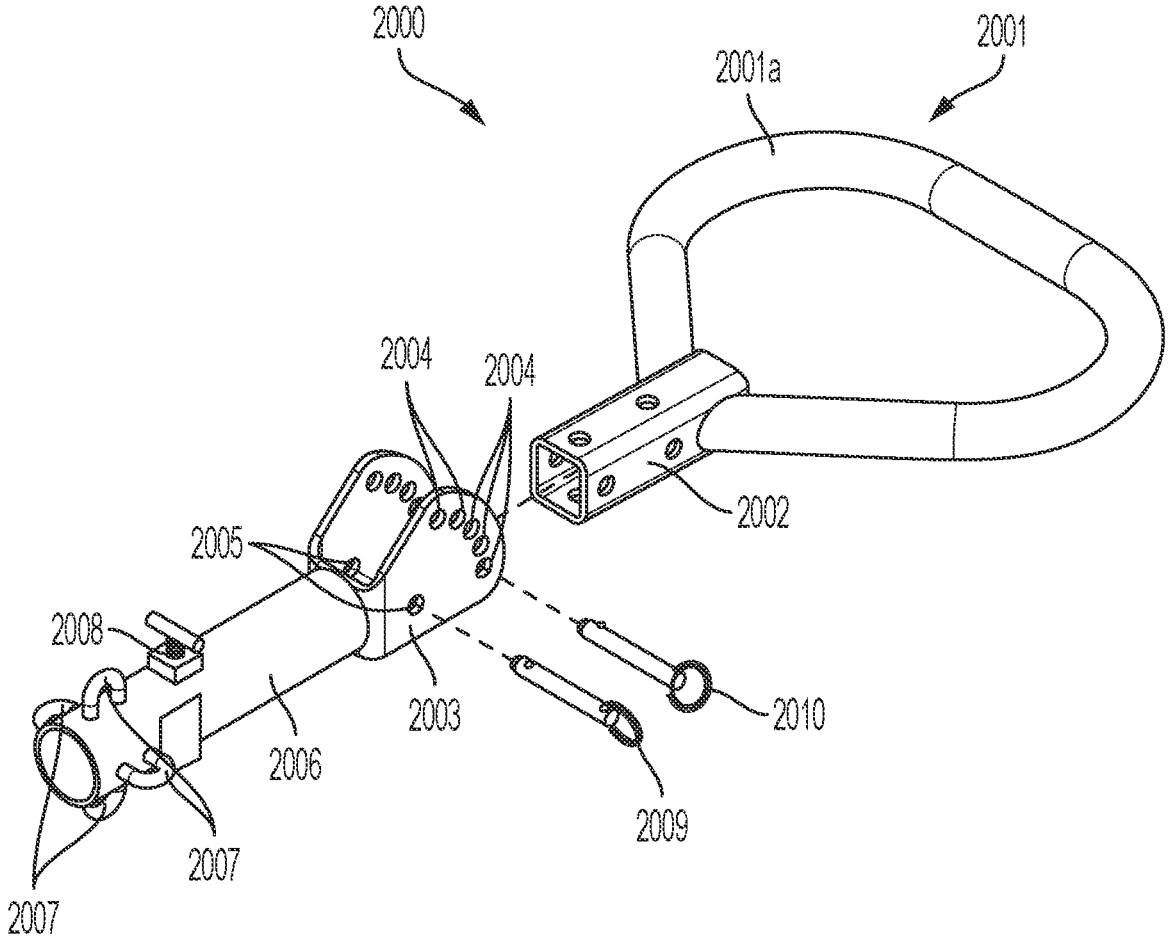
FIG. 1 shows an exploded view of an exemplary first exercise apparatus.

FIG. 1 is an exploded view of an exemplary apparatus 2000 including a handle 2001 and a cylindrical sleeve 2006. The handle 2001 (which is detachably attached to the cylindrical sleeve 2006) puts a user's elbows and hands in an optimal position (around 45 degrees with palms up and thumbs out) for various movements (including a triple extension squat and press) similar to movements displayed by various individuals such as, offensive and defensive linemen on a football or other field. A number of other functional movements are possible on the current apparatus, only limited by the imagination and creativity of the athlete and the handle used. Functional movements include but are not limited to: front squats, single and double shoulder press, abdominal rotations, one arm back rows, deadlifts, jump squats, upright rows, and high pulls.

As further shown in FIG. 1, an attachment such as handle 2001 is attached to the receiver 2006 by the use of pins 2009, 2010. The handle 2001 may can include a grip portion 2001*a* for being gripped by a hand of a user and an attachment portion 2002 that is affixed to the grip portion 2001*a*. The attachment portion 2002 has holes drilled on all sides for different orientations for the user. The attachment portion 2002 can be inserted into arcuate U-shaped member 2003 and a first connection device, such as pin 2009, can slide into holes 2003, 2005 to hold the attachment on the device. With this setup the handle 2001 can move freely all the way up or all the way down. If a second connection device, such as pin 2010, is inserted into holes 2004 of the arcuate U-shaped member 2003, the handle 2001 can be maintained at a selected angle. Cylindrical sleeve 2006 can slide onto a bar, such as for example, a weightlifting bar to allow the user free range of motion to use the apparatus 2000 in any manner they choose. Apparatus 2000 can be held onto the bar by use of an attachment device such as screw clamp, a strap system that attaches to one or more eyelets 2007 and to the bar, or by the use of a hinge clamp that tightens around the bar. Eyelets 2007 can be used to attach bands, ropes, chains, pulley system to the apparatus 2000. Handle 2001 allows the users hands, wrists, arms, and elbows to be positioned in line with the user's body for a more natural range of motion during the lift. A bottom portion of the grip portion 2001*a* can be arranged at approximately 45 degrees to the attachment portion 2002, but can be varying degrees. A top portion of grip portion 2001*a* can be generally straight to allow the user to hold the handle in front of the body. This attachment 2001 can have a smooth or a knurled grip.

Figure 2:
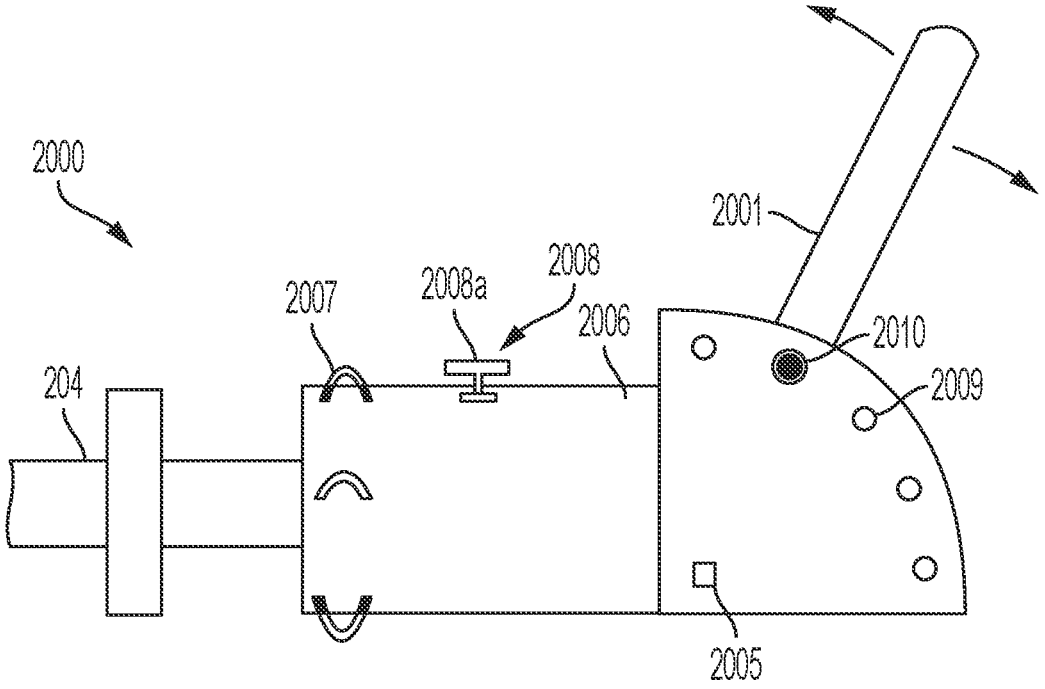
FIG. 2 illustrates side view of the exemplary first apparatus.

FIG. 2 illustrates side view of an example of the first exemplary apparatus. The cylindrical sleeve 2006 receives current apparatus 202 (henceforth referred to as the receiver) is connected to a bar 204 such as, for example, a 45 lb weightlifting bar, although any weight weightlifting bar may be used. The cylindrical sleeve 2006 can also be attached to a sled or other type of cylindrical projection 204 that will fit within the cylindrical sleeve 2006.

The cylindrical sleeve 2006 can slide onto one end of a bar 204 or other cylindrical projection 204 and is attached in various ways, such as by a strap that is fastened to the receiver and the bar 204, by a hinge clamp such as a barbell or spring clamp or attached by a clamp with a strap that tightens or loosens the clamp, or by the a screw clamp 2008 that can tighten onto the bar 204 or other cylindrical projection 204. For example, the screw clamp 2008 can clamp onto the bar 204 by assembling a button-head bolt from the inside of the tube and then welding a handle onto a head portion 2008 of the screw clamp 2008, thereby preventing the cylindrical sleeve 2006 from moving on the bar 204. Alternatively, the screw clamp 2008 can be a standard screw that simply tightens onto the barbell 204 or cylindrical projection.

At least one or more eyelets 2007 can be present on the cylindrical sleeve 2006 so that it is possible to attach a strap or the like and apply additional force to the exercise from other angles.

The arcuate U-shaped member 2003 receives the attachment portion 2002 of the handle 2001 and can connect to the attachment portion 2002 using the first connection device 2009 and the second connection device 2010. The first and second connection devices can be pins or screw clamps or the like. The first connection device 2009 passes through an end of the attachment portion 2002. The second connection device 2010 passes through holes 2004 to set the handle 2001 to the user's preferred angle.

Figure 3:
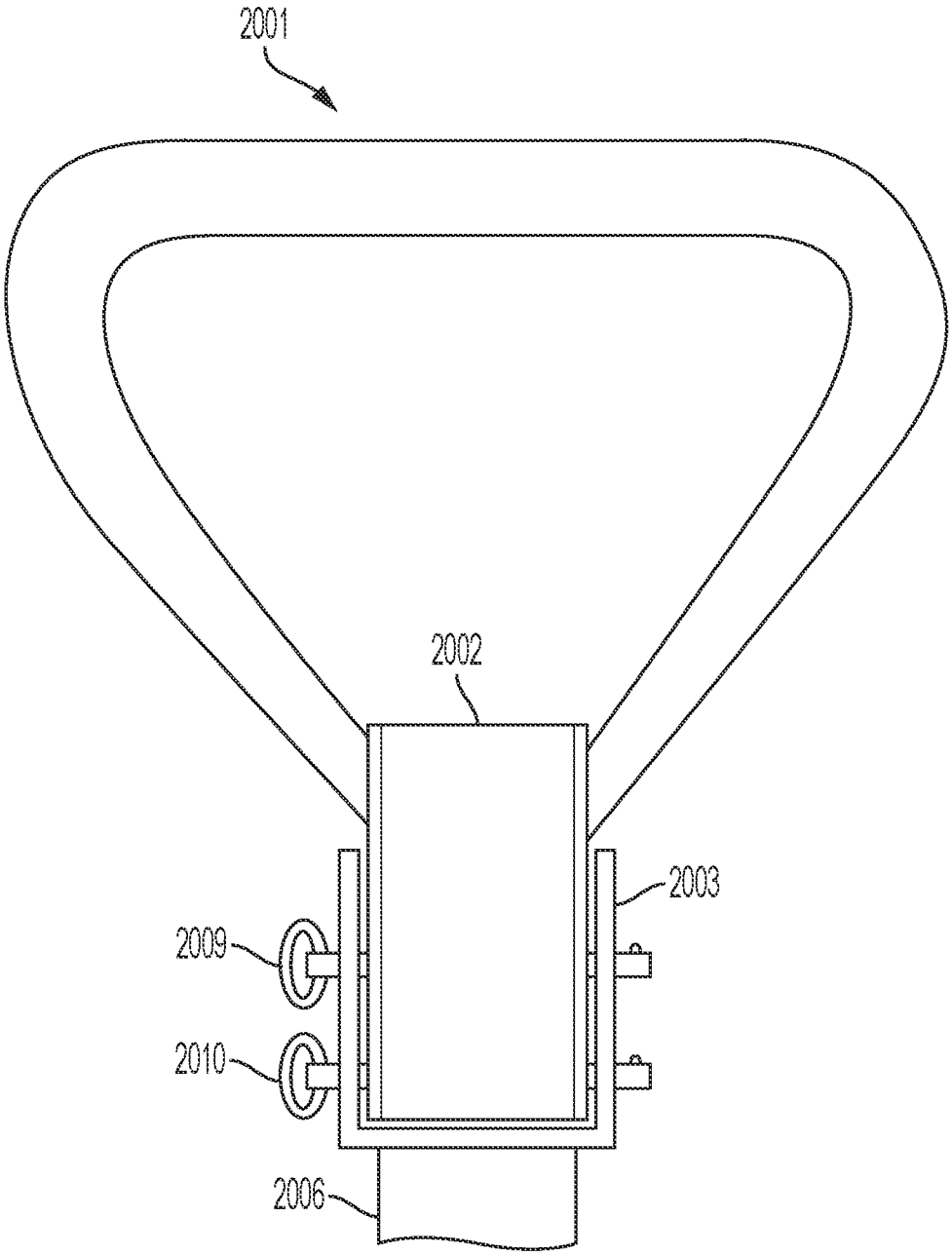
FIG. 3 illustrates top view of the exemplary first apparatus.

FIG. 3 illustrates top view of an example of the first apparatus. The handle 2001 can be attached to the arcuate U-shaped member 2003 receiver 306 via, for example, two pins 2009, 2010. The pins may be a screw type, or any other pin type. The first pin 2009 allows for the angle of the handle to be set, and the second pin 2010 hinges the base of the handle 304.

Figure 4:
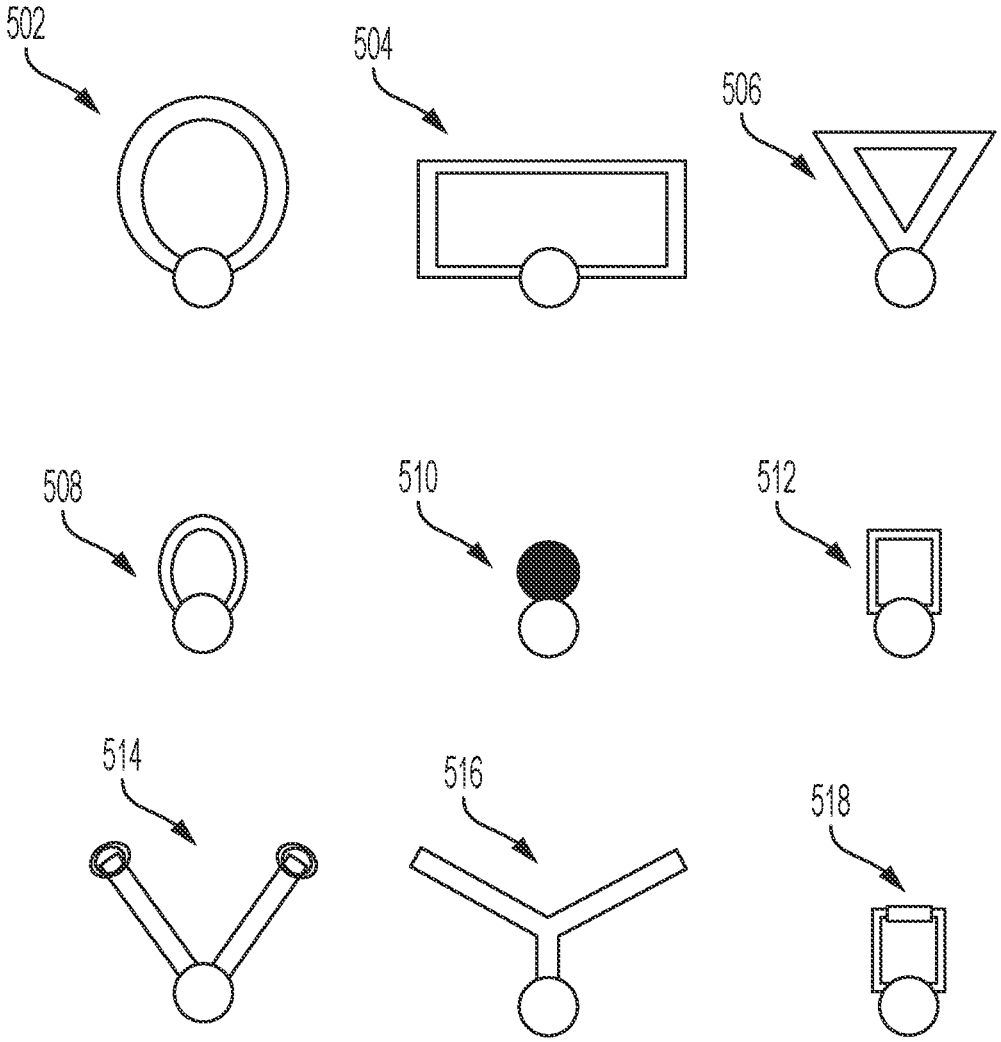
FIG. 4 illustrates different types of handles that may be connected to the exemplary first apparatus.

FIG. 4 is a diagram 500 of the different types of handles that may be connected to the receiver of the first apparatus 306. The cylindrical sleeve 2006 can accept a handle 2001 having many different configurations. Handle variations include but are not limited to: a large oblong circle 502, a rectangle 504, a triangle 506, a small oblong circle 508, a solid ball 510, a square 512, two small circles with approx. 45 degree handles inside 514, a "T" bar for back rows 516, individual handles 518, a squat attachment with padded shoulders (not depicted), a "T" Bar with small handle projections for neutral grip back rows (not depicted).

The handle 2001 can be permanent or removable. The attachment portion 2002 can have square or cylindrical tubing that slides into the onto the square or cylindrical tubing of the arcuate U-shaped member 2003.

Figure 5:
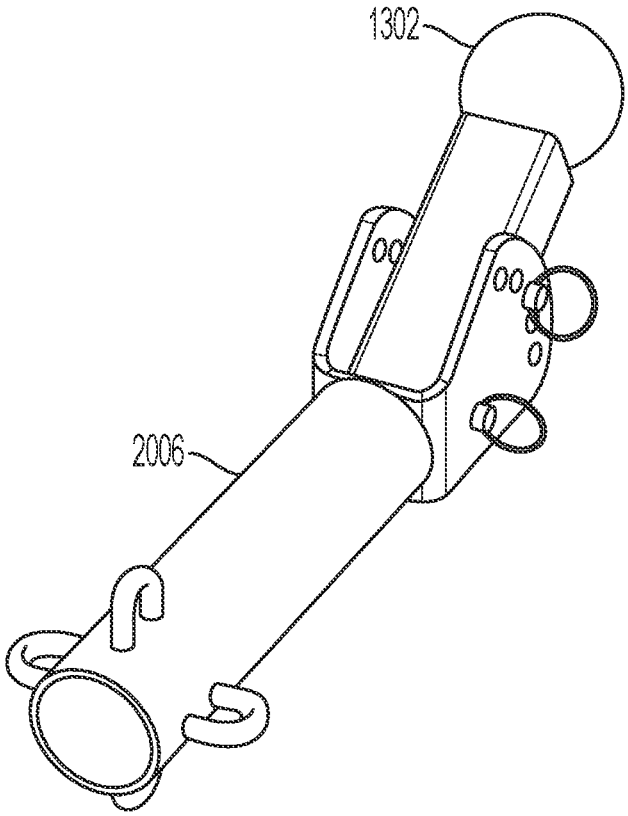
FIG. 5 illustrates an exemplary first apparatus including a ball handle attachment.

FIG. 5 illustrates an another exemplary embodiment of the apparatus 2000 that includes a ball handle attachment 1300. This attachment allows the user to gain grip strength by gripping the ball 1302 with a single hand and pressing, pulling, holding the attachment in various ways on the current apparatus. The ball 1302 can mimic an Olympic shot putter by holding the ball near the neck area and thrusting in an upwards and outwards motion. This attachment can also be attached to the second apparatus' attachment slot used on the ground to hold up an athlete attempting an unstable push up. The ball handle will also have a smaller handle that is attached between the metal 2×2 tubing and ball. This allows the user an additional grip to hold onto and execute weightlifting movements.

Figure 6:
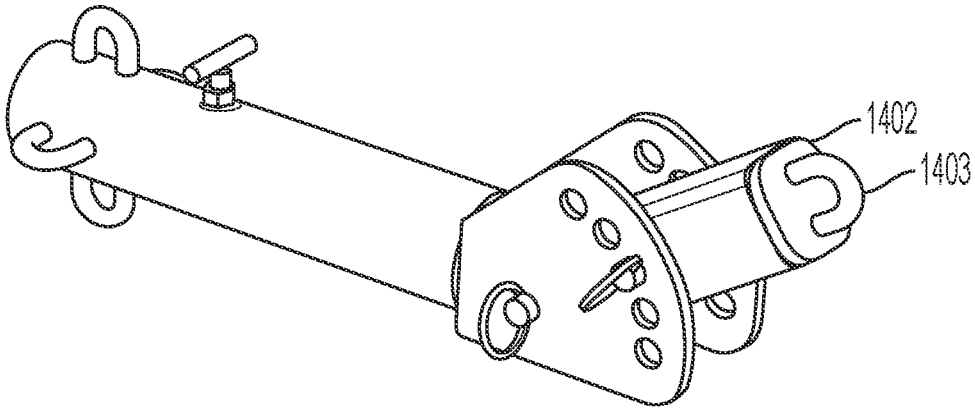
FIG. 6 illustrates an exemplary first apparatus including a universal link.

FIG. 6 illustrates another exemplary embodiment of the apparatus 2000 including a universal link 1402 that allows the user to attach any device. The universal kink 1402 includes a generally U-shaped attachment portion 1403 to which can be attached a chain or other device (not shown).

Figure 7:
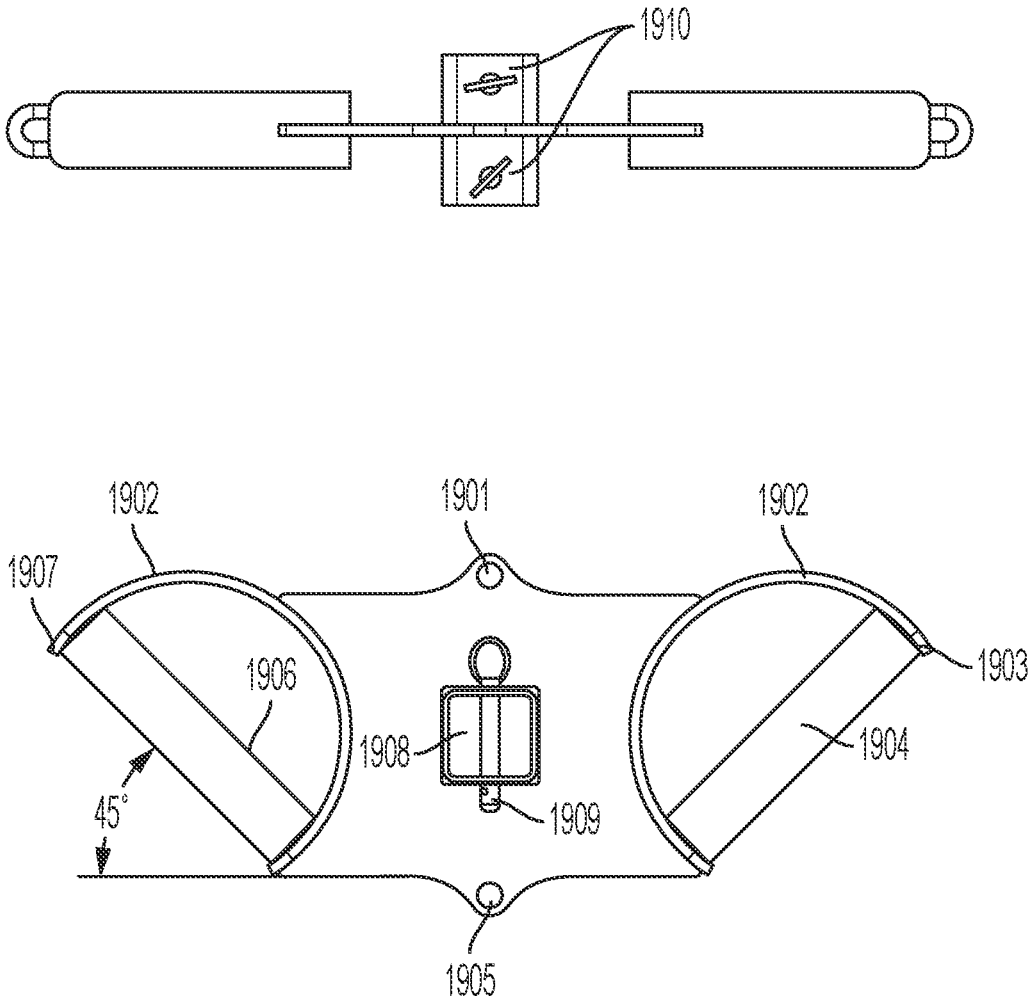
FIG. 7 illustrates a top view and a side view of an exemplary second apparatus.

FIG. 7 shows an exemplary second apparatus 1900. The second apparatus is a device designed to put an individual (such as an offensive or defensive line athlete) in a core dominated position by simulating athletic movements that recruit stabilizer and core muscles that are utilized when receiving pressure from an opponent (such as an offensive lineman in a pass protection or run blocking scenario). A user's elbows are tucked in close to the midline of the body and the hands externally rotated away from the midline, gripping the handles positioned around 45 degrees inside the wheel with the palms substantially up and thumbs substantially out.

In an exemplary embodiment, the inside handles of the second apparatus has the capability of rotating 360 degrees within the circular casing with the use of a ball bearing system installed around the outside edges of circular handles. The interior handles can also rotate on a fixed bolt, such as a shoulder bolt, installed on the top or bottom of the circular handles.

An added functionality of the second apparatus is the ability to place attachments in the center of the device. These attachments include: another "eyelet" for attaching more bands/ropes/weight, a half dome pad that allows a coach to apply pressure to the user holding the device, a cylindrical projection to receive weight, and the ability to attach the device to a projection that is attached to a sled for pushing.

These attachments can be placed in a number of ways, such as screwed into a permanent thread located in the middle of the device between the handles, attached by clamp or locking mechanism along the outside metal, with square tubing inserted into a sleeve on the Second apparatus held tightly by 2 pins, etc.

The second apparatus 1900 can allow the user to get a more sport specific core workout while taking repetitions in his or her stance. Many core or abdominal exercises have the athlete on the floor, however, in competition the athlete is standing, moving, running, etc. With band and or rope attachments the user can strengthen and stabilize his or her core while recreating movements used on the playing field for a more real life application to strength training. The device is mobile in nature and can be used during practice or in the weight room. In order to engrain the necessary movement patterns of offensive line play (pass setting, striking opponents, run blocking, etc.) the athlete must practice over and over. The constant hitting of athletes in pads can be detrimental to their bodies. This device will help many offensive line athletes strengthen their core and develop the necessary movement patterns for offensive line play without the beating and stress on their joints.

FIG. 7 illustrates an exemplary second apparatus 1900. Holes 1901, 1903, 1905 and 1907 can allow the user to attach ropes, bands, chains, pulley systems, etc. to the device to create anti-rotational pressure on the athlete holding the device with handles 1904 and 1906. Alternatively, as shown in FIG. 7, curved attachment devices can also be used attach resistance sources. The apparatus 1900 can be held in an upright or downright position for varying handle (1904 and 1906) orientations to achieve different stresses on the user's muscles and joint orientations. Half circle insets 1902 can be fixed in one position and/or have the capability of rotating in any position 360 degrees with the use of ball bearings within an enclosed frame or with the use of a pinned system to fixate the handles in the desired orientation. Center attachment receiver 1908 allows the user to attach an additional apparatus to the device 1900 by sliding the attachments post through the center and attaching with pins such as 1910. Handles 1904 and 1906 can be knurled or smooth.

What is claimed is:

1. An apparatus for connecting to a barbell, the apparatus, comprising:

a handle comprising:

a grip portion for being gripped by a hand of a user, and an elongated attachment portion comprising a plurality of attachment holes;

a cylindrical sleeve comprising:

a first end and a second end, the first end configured to receive the barbell, an arcuate U-shaped member connected to the second end, the arcuate U-shaped member comprising a pair of substantially parallel spaced leg portions each including a plurality of arcuately arranged holes that cooperate with the plurality of attachment holes to arrange the handle at a selected angle relative to a longitudinal axis of the cylindrical sleeve; and a first locking mechanism in the cylindrical sleeve configured to secure the barbell in the cylindrical sleeve, the first locking mechanism including a head portion inside the cylindrical sleeve that prevents the first locking mechanism from being removed from the cylindrical sleeve.

2. The apparatus of claim 1, wherein the plurality of arcuately arranged holes are configured to allow the handle to be arranged to move from about 0 degrees relative to the longitudinal axis to about 90 degrees relative to the longitudinal axis.

3. The apparatus of claim 1, wherein the handle further comprises:

first securing holes distally spaced from the plurality of attachment holes on the elongated attachment portion, and wherein the arcuate U-shaped member further comprises:

second securing holes that cooperate with the first securing holes to prevent a rotation of the handle.

4. The apparatus of claim 1, further comprising:

a first securing device to engage a pair of arcuately arranged holes, of the plurality of arcuately arranged holes, and a pair of attachment holes of the plurality of attachment holes of the elongated attachment portion; and a second securing device to engage a pair of first securing holes, of the first securing holes, and the second securing holes.

5. The apparatus of claim 1, further comprising:

a plurality of U-shaped protrusions arranged around the cylindrical sleeve proximate to the first end, wherein the plurality of U-shaped protrusions are configured to secure one or more of:

a weight, a strap, and a band.

6. The apparatus of claim 5, wherein the plurality of U-shaped protrusions are spaced equidistantly around the cylindrical sleeve.

7. The apparatus of claim 1, wherein the grip portion is one or more of:

substantially circular, substantially square, substantially rectangular, substantially triangular, and a solid shape.

8. An exercise handle for attachment to a resistance, the exercise handle comprising:

a central portion having two ends, an opening that attaches to the resistance, and a plurality of openings arranged proximate to a periphery of the central portion for attachment to one or more second resistances;

an end portion located on each end of the central portion;

a substantially semicircular portion disposed at each end portion; and a handle rotatably mounted in each substantially semicircular portion.

9. The apparatus of claim 8, wherein each of the substantially semicircular portions includes an opening for attachment to an external resistance.

10. The apparatus of claim 8, wherein each handle is connected to a corresponding substantially semicircular portion by a ball bearing system.

* * * * *